US012660974B2

(12) United States Patent
Koh

(10) Patent No.: US 12,660,974 B2
(45) Date of Patent: Jun. 23, 2026

(54) EXTRACTION CLEANER WITH ROTATING TOOL GRIP

(71) Applicant: BISSELL Inc., Grand Rapids, MI (US)

(72) Inventor: Daniel Koh, Kulai (MY)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 18/409,362

(22) Filed: Jan. 10, 2024

(65) Prior Publication Data

US 2024/0237865 A1 Jul. 18, 2024

Related U.S. Application Data

(60) Provisional application No. 63/438,577, filed on Jan. 12, 2023.

(51) Int. Cl.

| | |
|---|---|
| ***A47L 11/20*** | (2006.01) |
| ***A47L 11/30*** | (2006.01) |
| ***A47L 11/40*** | (2006.01) |

(52) U.S. Cl.

CPC ..... *A47L 11/201* (2013.01); *A47L 11/30* (2013.01); *A47L 11/4086* (2013.01); *A47L 11/4088* (2013.01)

(58) Field of Classification Search

USPC ..... 285/7, 282

See application file for complete search history.

(56) References Cited

U.S. PATENT DOCUMENTS 2,982,519 A 5/1961 Lionel et al.
4,083,077 A * 4/1978 Knight ..... A47L 11/34 15/322
4,327,459 A * 5/1982 Gilbert ..... A47L 11/4083 392/333
4,558,889 A 12/1985 Gans (Continued)

FOREIGN PATENT DOCUMENTS

AU 2019236607 A1 4/2020
AU 2020270493 A1 6/2021

(Continued)

OTHER PUBLICATIONS

'Tool'. Google's English Dictionary [online]. [Retrieved on Aug. 14, 2025]. Retrieved from the internet:<https://www.google.com/search?q=tool+definition>. (Year: 2025).*

(Continued)

*Primary Examiner* — Craig M Schneider
(74) *Attorney, Agent, or Firm* — WARNER NORCROSS + JUDD LLP

(57) ABSTRACT

An extraction cleaner is provided. The extraction cleaner includes a housing supporting a fluid delivery system configured to store cleaning fluid and to deliver the cleaning fluid to a surface to be cleaned, and a fluid recovery system configured to remove the fluid and debris from the surface to be cleaned and to store the recovered fluid and debris. A flexible hose includes a first conduit in fluid communication with the fluid delivery system and a second conduit in fluid communication with the fluid recovery system. A hand-held (Continued)

cleaning tool including a fluid distributor and a suction inlet is rotatably coupled with an end of the hose. The cleaning tool swivels relative to the flexible hose in a limited angle of rotation.

19 Claims, 8 Drawing Sheets

(56) References Cited

U.S. PATENT DOCUMENTS

| | | | | |
|---|---|---|---|---|
| 5,039,133 | A | 8/1991 | Albrecht | |
| 5,042,844 | A | 8/1991 | Iida et al. | |
| 5,389,004 | A | 2/1995 | Gray et al. | |
| 5,727,739 | A * | 3/1998 | Hamilton | B05B 15/00 285/361 |
| 6,478,342 | B1 | 11/2002 | Berfield | |
| 6,581,974 | B1 | 6/2003 | Ragner et al. | |
| 7,260,869 | B2 | 8/2007 | Kim | |
| 7,356,876 | B2 | 4/2008 | Dant et al. | |
| 7,488,004 | B1 | 2/2009 | Romani et al. | |
| 7,805,806 | B2 | 10/2010 | Linhart et al. | |
| 8,407,853 | B1 | 4/2013 | Baxt | |
| 8,522,394 | B2 | 9/2013 | Lee et al. | |
| 9,554,680 | B2 | 1/2017 | Elsdon et al. | |
| 9,615,703 | B2 * | 4/2017 | Moyher, Jr. | A47L 9/0036 |
| 9,867,517 | B2 | 1/2018 | Krebs et al. | |
| 9,955,834 | B2 | 5/2018 | Lee et al. | |
| 10,292,555 | B2 | 5/2019 | Prosser | |
| 10,426,308 | B2 | 10/2019 | Stanek et al. | |
| 10,555,650 | B2 | 2/2020 | Genn et al. | |
| 10,631,696 | B1 | 4/2020 | Williamson | |
| 10,660,494 | B1 | 5/2020 | Alton | |
| 10,874,272 | B2 | 12/2020 | Storti, Jr. | |
| 11,160,426 | B1 | 11/2021 | Williamson | |
| 12,564,976 | B2 | 3/2026 | Wu | |
| 2007/0266519 | A1 * | 11/2007 | Kostreba | A47L 7/0009 15/321 |
| 2008/0184517 | A1 * | 8/2008 | Phelan | F16L 37/252 15/300.1 |
| 2009/0188067 | A1 | 7/2009 | White et al. | |
| 2016/0051308 | A1 * | 2/2016 | Pennybacker | F16L 27/02 606/20 |
| 2019/0104906 | A1 * | 4/2019 | Royale | A47L 11/4088 |
| 2019/0246853 | A1 | 8/2019 | Sardar et al. | |

FOREIGN PATENT DOCUMENTS

| | | | |
|---|---|---|---|
| CA | 2554096 | C | 3/2009 |
| CA | 2928764 | C | 11/2021 |
| CN | 102334956 | A | 2/2012 |
| CN | 206714705 | U | 12/2017 |
| CN | 212698710 | U | 3/2021 |
| DE | 102008055043 | B4 | 4/2013 |
| DE | 202016005842 | U1 | 11/2016 |
| DE | 102015102587 | B4 | 10/2019 |
| DE | 202020100200 | U1 | 1/2020 |
| DE | 112014005262 | B4 | 11/2021 |
| EP | 2929821 | A1 | 10/2015 |
| EP | 2815685 | B1 | 3/2017 |
| EP | 3185742 | B1 | 10/2019 |
| EP | 3232888 | B1 | 10/2021 |
| EP | 3232889 | B1 | 10/2021 |
| FR | 2847792 | A1 | 6/2004 |
| JP | 3286250 | B2 | 5/2002 |
| JP | 3649914 | B2 | 5/2005 |
| JP | 2005205229 | A | 8/2005 |
| JP | 2005211674 | A | 8/2005 |
| JP | 2014008303 | A | 1/2014 |
| JP | 6402358 | B2 | 10/2018 |
| JP | 6417538 | B2 | 11/2018 |
| JP | 6518933 | B2 | 5/2019 |
| JP | 6533947 | B2 | 6/2019 |
| JP | 6572426 | B2 | 9/2019 |
| WO | 2022150395 | A1 | 7/2022 |
| WO | 2023213887 | A2 | 11/2023 |

OTHER PUBLICATIONS

The Extended European Search Report issued by the European Patent Office in Application No. EP24150267, mailed Jun. 6, 2024 (5 pages).

* cited by examiner

EXTRACTION CLEANER WITH ROTATING TOOL GRIP

CROSS-REFERENCE TO RELATED APPLICATION(S)

This application claims the benefit of U.S. Provisional Application No. 63/438,577, filed Jan. 12, 2023, the disclosure of which is incorporated herein by reference in its entirety.

BACKGROUND

Extractors are well-known surface cleaning devices for deep cleaning carpets and other fabric surfaces, such as upholstery. Most extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a conduit, and a source of suction in fluid communication with the conduit to draw the cleaning fluid from the surface to be cleaned and through the nozzle and the conduit to the recovery tank. Other wet cleaning apparatuses include steam cleaners that dispense steam, and spot cleaners that may dispense liquid and scrub the surface, but do not recover liquid.

Extractors and other wet cleaners can be adapted to be hand-carried by a user, and in some cases include a hose coupled with a tool carrying the fluid distributor and nozzle.

BRIEF SUMMARY

An extraction cleaner is provided herein. The extraction cleaner has a housing supporting a fluid delivery system configured to store cleaning fluid and to deliver the cleaning fluid to a surface to be cleaned, and a fluid recovery system configured to remove the fluid and debris from the surface to be cleaned and to store the recovered fluid and debris. A flexible hose extends from the housing and includes a first conduit in fluid communication with the fluid delivery system and a second conduit in fluid communication with the fluid recovery system. A hand-held cleaning tool including a fluid distributor and a suction inlet is rotatably coupled with a distal end of the hose. The cleaning tool swivels relative to the flexible hose in a limited angle of rotation.

According to one aspect of the disclosure, the cleaning tool comprises a wand and an accessory tool removably connected to the wand. A hose collar is disposed on the end of the flexible hose and a receiver is disposed at a rear end of the wand opposite the accessory tool connected to the wand.

In one of its aspects, the hose collar includes a cylindrical outer surface and at least one projection extending outwardly from the cylindrical outer surface. The receiver includes a circular outer rim, a cylindrical inner surface extending inwardly from the outer rim, and at least one arcuately extending guide groove disposed in the cylindrical inner surface. Each one of the projections is received in a unique one of the guide grooves.

In another of its aspects, each guide groove extends less than 180 degrees around the circumference of the cylindrical inner surface.

In yet another of its aspects, each guide groove extends approximately 90 degrees around the circumference of the cylindrical inner surface.

In a further aspect, the fluid delivery system comprises a liquid/steam delivery system configured to deliver the cleaning fluid to the surface to be cleaned as liquid, steam, or both.

In yet a further aspect, the extraction cleaner is a portable deep cleaner and the housing comprises a hand-carried body adapted to be hand carried by a user.

In an alternative aspect, the extraction cleaner is an upright deep cleaner and the housing comprises a base adapted to move over a surface to be cleaned and an upright body coupled with the base.

A hose assembly for an extraction cleaner having a fluid delivery system and a fluid recovery system is also provided. The hose assembly includes a flexible hose comprising at least a liquid delivery conduit and a working air conduit. A hand-held cleaning tool is rotatably coupled with an end of the hose. The cleaning tool includes a fluid distributor and a suction inlet. A hose collar is disposed on the end of the hose. A receiver is disposed at a rear end of the cleaning tool. The receiver includes a circular outer rim, a cylindrical inner surface extending inwardly from the outer rim, and at least one arcuately extending guide groove disposed in the cylindrical inner surface. The hose collar includes a cylindrical outer surface and at least one projection extending outwardly from the cylindrical outer surface. The at least one projection is cooperable with the at least one guide groove such that the cleaning tool swivels relative to the flexible hose in a limited angle of rotation.

In one of its aspects, the hose assembly includes two of said guide grooves and a corresponding two of said projections.

In another of its aspects, each guide groove extends approximately 90 degrees around the circumference of the cylindrical inner surface.

In yet another of its aspects, each guide groove includes a lip adjacent the outer rim.

In yet another of its aspects, a plurality of anti-tilt ribs extend axially along the cylindrical inner surface of the receiver.

In yet another of its aspects, a raised surface is axially aligned with each of the projections.

In yet another of its aspects, the flexible hose further includes a steam delivery conduit.

The embodiments of an extraction cleaner with the coupling of the wand to the hose collar disclosed herein enable a better cleaning experience. Swiveling of the wand/tool relative to the hose provides easier manipulation of the tool to reach a surface area to be cleaned.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to an extraction cleaner with a rotating tool grip. Aspects of the disclosure described herein relate to an extraction cleaner that delivers cleaning fluid to a surface to be cleaned and that also extracts cleaning fluid and debris from the surface. Aspects of the disclosure described herein are further related to a portable extraction cleaner (e.g., a deep cleaner) that is adapted to be hand carried by a user to carpeted, upholstered, and other areas for cleaning relatively small areas. Other aspects of the disclosure described herein are related to an upright extraction cleaner (e.g., a deep cleaner) that is adapted to be moved over a surface to be cleaned.

Figure 1:
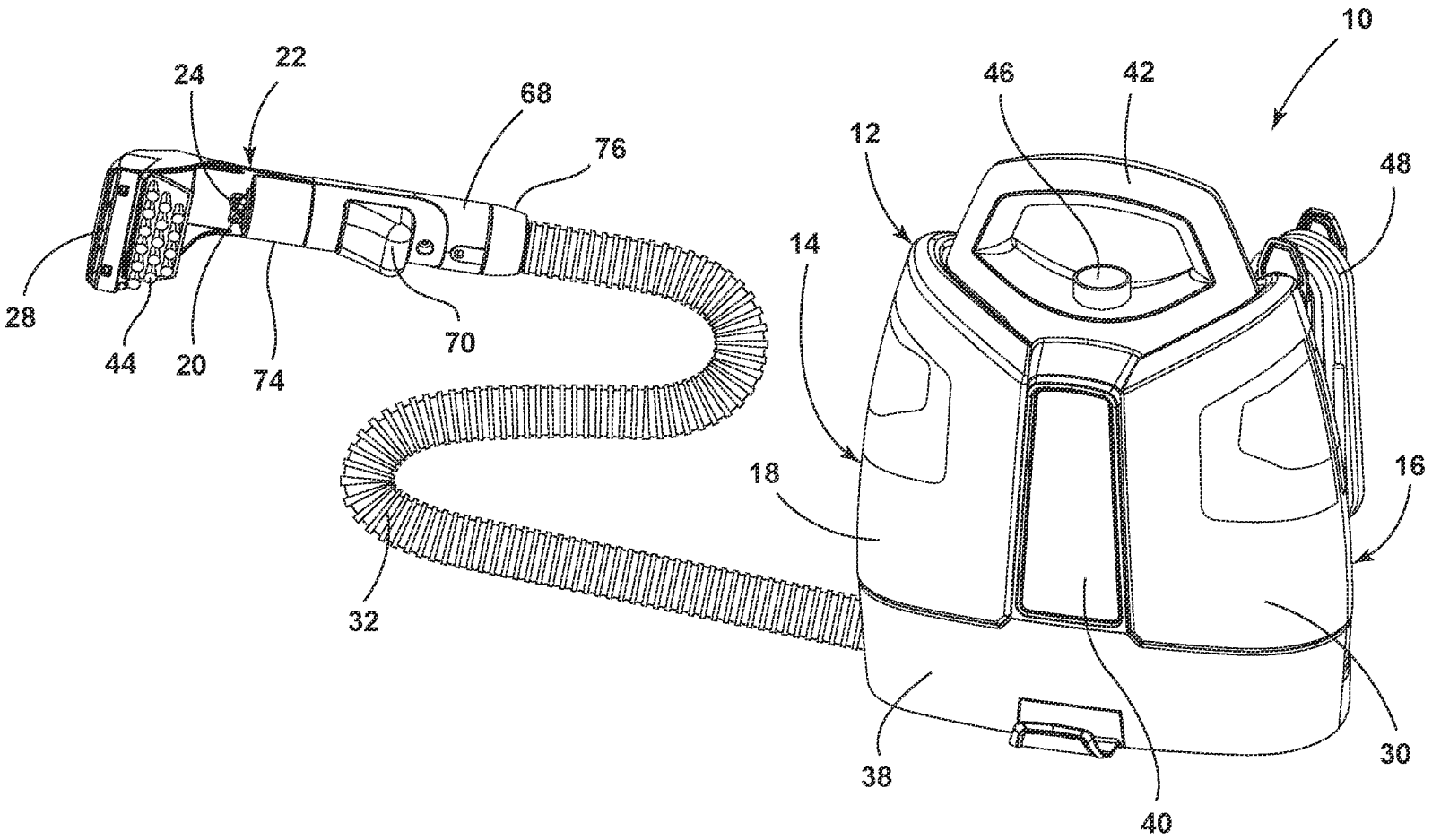
FIG. 1 is a perspective view of a portable extraction cleaner with a rotating tool grip according to some embodiments of the invention.
Figure 2:
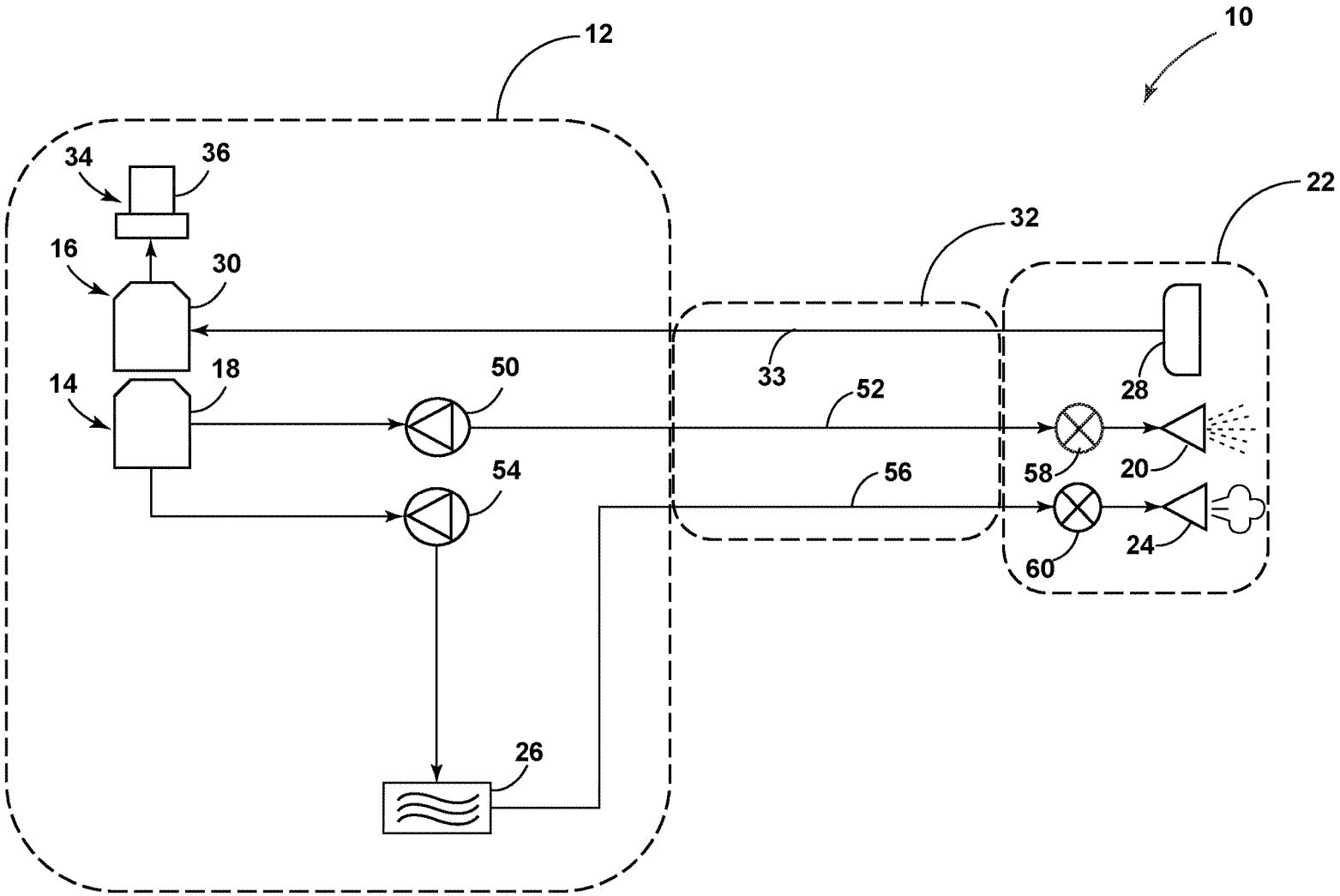
FIG. 2 is a schematic view of the portable extraction cleaner of FIG. 1.
Figure 3:
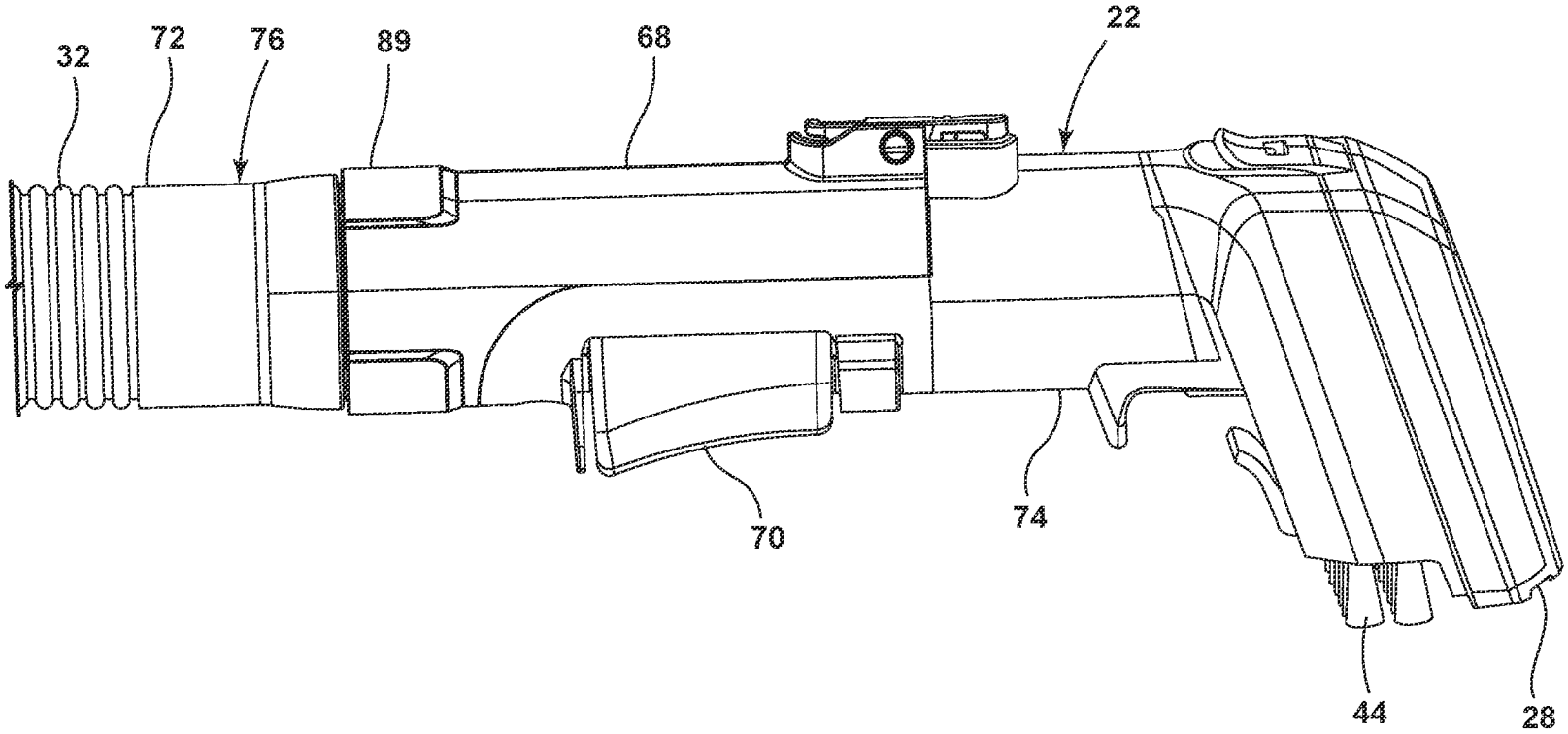
FIG. 3 is an enlarged side view of a cleaning tool and flexible hose end of the portable extraction cleaner of FIG. 1.

FIGS. 1-2 show a surface cleaning apparatus with steam delivery in the form of a portable extraction cleaner (deep cleaner) 10 according to a first embodiment of the invention. The extraction cleaner 10 includes a hand-carried body including a main housing 12, a fluid delivery system 14 configured to store cleaning fluid and to deliver the cleaning fluid to the surface to be cleaned, and a fluid recovery system 16 configured to remove the fluid and debris from the surface to be cleaned and to store the recovered fluid and debris. The fluid delivery system 14 can more particularly be a liquid/steam delivery system 14 configured to store cleaning fluid and to deliver the cleaning fluid to the surface to be cleaned as liquid, steam, or both.

For purposes of description related to the figures, the terms upper, lower, vertical, horizontal, and derivatives thereof shall relate to the exemplary extraction cleaner 10 as oriented in FIG. 1, with the extraction cleaner 10 resting on a surface or being carried by the carry handle. However, it is to be understood that aspects of the present disclosure may assume various alternative orientations, except where expressly specified to the contrary.

The main housing 12 is adapted to selectively mount components of the fluid delivery system 14 and the fluid recovery system 16 to form an easy-to-carry unit that can be transported by a user to different locations with surfaces to be cleaned. The extraction cleaner 10 is adapted to be hand carried by a user to carpeted areas for cleaning relatively small areas and extract cleaning fluid and debris from the surface. Additional, non-limiting examples of areas that can be cleaned include area rugs, upholstery, vehicle interiors, drapery, and mattresses.

The fluid delivery system 14 can include a supply tank 18 for storing a supply of cleaning fluid, a fluid (liquid) distributor 20 provided on a hand-held cleaning tool 22, and a steam distributor 24 provided on a hand-held cleaning tool 22. A heater 26 is provided in the flow path between the supply tank 18 and the steam distributor 24 to heat the cleaning fluid to produce steam.

The cleaning fluid stored by the supply tank 18 can comprise one or more of any suitable cleaning liquids, including, but not limited to, water, compositions, concentrated detergent, diluted detergent, etc., and mixtures thereof. For example, the fluid can comprise a mixture of water and concentrated detergent. The cleaning fluid can be stored in liquid form.

The supply tank 18 can be refillable, and can be formed of a transparent or tinted translucent material, which permits a user to view the contents thereof. The supply tank 18 can be removably mounted on the main housing 12.

The heater 26 preferably heats the cleaning fluid to about 100° C., where "about" includes ±10° C. This temperature may be the temperature at the steam distributor 24. Since some heat loss between the outlet of the heater 26 and the steam distributor 24 is possible, the setpoint of the heater 26 may be higher. One non-limiting example of a setpoint for the heater 26 is from about 165 to about 180° C. Some non-limiting examples of a suitable heater 26 include, but are not limited to, a flash heater, a boiler, an immersion heater, and a flow-through steam generator.

The heater 26 may produce steam. As used herein, the term "steam" includes a liquid, such as but not limited to water or solutions containing water (like water mixed with a cleaning chemistry, fragrance, etc.), at least partially converted to a gas or vapor phase. The liquid can be boiled or otherwise converted to the gas or vapor phase by heating or mechanical action like nebulizing. In other embodiments, the heater 26 produces heated cleaning fluid in a mixture of vapor phase and liquid phase. It is also understood that, regardless of the phase of cleaning fluid output by the heater 26, the phase composition of the cleaning fluid may change between the heater 26 and the steam distributor 24, with heat loss and/or condensation returning a portion of the fluid in the vapor phase to the liquid phase. Likewise, the temperature of the cleaning fluid output by the steam distributor 24 may be less than the temperature of cleaning fluid output by the heater 26. For example, the heater 26 may have a setpoint in the range of about 165 to about 180° C., however, the fluid dispensed by the steal distributor 24 (after traveling along about 6 foot of tubing between an outlet of the heater 26 and the steam distributor 24) may comprise a mixture of vapor and liquid droplets having a temperature of less than about 100° C. For example, the mixture of vapor and liquid droplets dispensed by the steam distributor 24 can have a temperature in a range of from about 90° C. to about 100° C., about 90° C. to about 99° C., about 90° C. to about 98°

C., about 90° C. to about 97° C., about 90° C. to about 96° C., about 90° C. to about 95° C., about 90° C. to about 94° C., about 94° C. to about 100° C., about 94° C. to about 99° C., about 94° C. to about 98° C., about 94° C. to about 97° C., about 94° C. to about 96° C., about 94° C. to about 95° C., about 95° C. to about 100° C., about 95° C. to about 99° C., about 95° C. to about 98° C., about 95° C. to about 97° C., about 95° C. to about 96° C., about 96° C. to about 100° C., about 96° C. to about 99° C., about 96° C. to about 98° C., about 96° C. to about 97° C., about 97° C. to about 100° C., about 97° C. to about 99° C., about 97° C. to about 98° C., about 98° C. to about 100° C., about 98° C. to about 99° C., or about 99° C. to about 100° C. Without being limited by any theory, the difference in temperature of the fluid exiting the heater 26 and the fluid dispensed from the steam distributor 24 may be due at least in part to loss of heat to the surrounding environment as the fluid travels between heater 26 and the steam distributor.

The fluid recovery system 16 can include an extraction path in the form of an extraction nozzle 28 provided on the cleaning tool 22, which is adapted to be used on the surface to be cleaned, a recovery tank 30, and a flexible hose assembly 32 defining a portion of a vacuum or suction conduit 33 in fluid communication with the extraction nozzle 28 and the recovery tank 30. The recovery tank 30 can include an air/liquid separator (not shown) that includes a stack for guiding air and liquid through the recovery tank 30 and a float for selectively closing the extraction path through the recovery tank 30. Examples of suitable air/liquid separators are disclosed in U.S. Pat. No. 7,073,226, issued Jul. 11, 2006, and U.S. Pat. No. 9,615,703, issued Apr. 11, 2017, both of which are incorporated herein by reference in their entirety. Other air/liquid separators are possible. The recovery tank 30 can be formed of a transparent or tinted translucent material, which permits a user to view the contents thereof. The recovery tank 30 can be removably mounted on the main housing 12.

The fluid recovery system 16 further includes a suction source 34, for example in the form of a motor/fan assembly including a vacuum motor 36, in fluid communication with the extraction nozzle 28 for generating a working airflow to draw liquid and entrained debris through the extraction path. The suction source 34 can be provided fluidly downstream of the recovery tank 30, although other extraction paths are possible.

Various arrangements for the housing 12 and tanks 18, 30 are possible. In one arrangement, the main housing 12 can include a carry handle 42 to form an easy-to-carry unit with the supply and recovery tanks 18, 30 that can be transported by a user to different locations with surfaces to be cleaned. The main housing 12 can further include a base 38 on which the supply and recovery tanks 18, 30 are at least partially supported, and a partition 40 extending upwardly from the base 38, between the supply and recovery tanks 18, 30. The partition 40 can comprise an enclosure housing one or more components of the extraction cleaner 10, such as the heater 26 and the suction source 34.

The base 38 can comprise a housing with a flat bottom that is adapted to rest directly on a surface, such as a horizontal surface or floor surface. Conveniently, the carry handle 42 can be provided opposite the flat bottom so that a user can easily pick up the extraction cleaner 10.

In FIG. 1, the hand-held tool 22 and hose 32 are shown in a use or operational position. The hand-held tool 22 and hose 32 may be stored on the main housing 12, for example by wrapping the hose 32 around the base 38 and the tool 22 clipped or otherwise attached to the housing 12.

A brush 44 can be provided on the tool 22 for scrubbing the surface to be cleaned. As shown in the illustrated embodiment, the brush 44 can comprise a plurality of bristles. The bristles can be bundled together in tufts to provide the desired stiffness and durability for agitation. Other agitators for the tool 22 are possible.

A user interface 46 through which the user can provide inputs to control the extraction cleaner 10, including the systems or components thereof, is provided on the cleaner 10. The user interface 46 accept inputs to control the supply of power from a power source of the extraction cleaner 10 to one or more electrical components of the extraction cleaner 10. The user interface 46 may include a rotary dial selector that can be rotated by a user between multiple positions to select a cleaning mode and to turn the extraction cleaner off. In other embodiments, the user interface 46 may include individual buttons or switches that allow a user to select a particular cleaning mode, optionally with a separate power switch. The power source of the extraction cleaner 10 can, for example, comprise a power cord 48 or a battery onboard the extraction cleaner 10. The user interface 46 is shown herein as provided adjacent the carry handle 42. Other configurations for the user interface 46 are possible.

Various other components and combinations of components can be incorporated into the fluid delivery system 14, such as pumps, valves, and/or fluid control features, as well as suitable conduits or tubing fluidly connecting the components of the fluid delivery system 14 together to effect the supply of cleaning fluid from the supply tank 18 to the distributors 20, 24.

In one embodiment, the fluid delivery system 14 includes a flow control system for controlling the flow of fluid from the supply tank 18 to the distributors 20, 24. In one configuration, the flow control system can comprise a liquid supply pump 50 which pressurizes a liquid dispensing path 52 of the system 14 and controls the delivery of cleaning fluid to the liquid distributor 20, and a steam supply pump 54 which pressurizes a steam dispensing path 56 of the system 14 and controls the delivery of steam to the steam distributor 24. The pumps 50, 54 can be a solenoid pump, a centrifugal pump, or the like. While separate pumps 50, 54 are illustrated for supplying fluid to the distributors 20, 24, respectively, it is within the scope of the present disclosure for a single, split, or multi-stage pump to be utilized to supply fluid to the distributors 20, 24.

In some embodiments, the liquid pump 50 delivers cleaning fluid at a higher flow rate than the steam pump 54. In one non-limiting example, the liquid pump 50 delivers cleaning liquid at a flow rate of about 400 mL/min measured at the liquid distributor 20 and the steam pump 54 delivers steam at a flow rate of about 40 mL/min measured at the steam distributor 24. In other embodiments, the pumps 50, 54 can have multiple speeds and/or flow rates so that a flow rate of cleaning fluid out of the distributors 20, 24 can be varied.

The paths 52, 56 can include one or more ducts, tubing, hoses, etc. fluidly coupling the components of the fluid delivery system 14 together. As shown in FIG. 2, portions of the suction conduit 33, the liquid dispensing path 52, and the steam dispensing path 56 can be defined by the flexible hose assembly 32 and the tool 22. For example, the paths 52, 56 can include separate liquid and steam conduits routed through the hose assembly 32, such as inside the suction conduit 33 used for extraction. In another embodiment, one or both of the liquid and steam conduits can be routed along an exterior of the suction conduit 33. Suitable air, liquid, and steam connectors (not shown) can be provided at either end of the hose assembly 32 for connection with the fluid supply and recovery components of the main housing 12 and the tool 22.

The dispensing of cleaning fluid by the tool 22 may be controlled by the user. For example, the extraction cleaner 10 can include dispensing valves 58, 60 that control the flow of cleaning fluid through the distributors, respectively to the distributors 20, 24, with the distributors 20, 24 configured to distribute cleaning fluid upon opening of the dispensing valves 58, 60. Aside from this function, the dispensing valves 58, 60 are not particularly limited, and may comprise any components and/or configurations suitable for use in/as a dispensing valve. The dispensing valves 58, 60 can, for example, be disposed on the hand-held cleaning tool 22 or on a wand (hand grip, handle) 68 connecting the cleaning tool 22 to the hose 32 and may be associated with appropriate user controls for operating the valves 58, 60.

The distributors 20, 24 can comprise any structure, such as a nozzle, a spray tip, or a manifold, and can comprise one or multiple outlets for cleaning fluid. In one non-limiting example, the liquid distributor 20 is a spray tip configured to distribute cleaning fluid upon opening of the valve 58 and the steam distributor 24 is a spray tip configured to distribute cleaning fluid upon opening of the valve 60. Referring to FIG. 1, the steam distributor 24 is shown located on an underside of the tool 22 adjacent the liquid distributor 20. In this location, the steam distributor 24 is located behind the extraction nozzle 28 and the brush 44, so that steam dispensed from the distributor 24 can be viewed by the user and does not get suctioned into the nozzle 28 before reaching the surface to be cleaned. In another embodiment, the steam distributor 24 can be a manifold located behind the inlet of the extraction nozzle 28 and in front of the brush 44.

The tool 22 can comprise at least one dispensing control operably connected to one of the valves 58, 60 to affect and control opening and closing of the valves 58, 60. Non-limiting examples of a dispensing control include a trigger, button, toggle, key, switch, or the like, or any combination thereof. For example, the release of cleaning fluid can be controlled by a trigger 70. The trigger 70 can operate both valves 58, 60, where depressing the trigger 70 opens both valves 58, 60. Release of the trigger 70 closes the valves 58, 60. The trigger 70 and valves 58, 60 can be located on the tool 22, or as shown in FIG. 1, on the wand 68 connecting the tool 22 to the hose 32.

Release of liquid and/or steam upon depression of the trigger 70 may or may not be mode-dependent. For example, depending on a selected cleaning mode of the extraction cleaner 10, depression of the trigger 70 may or may not release liquid to the liquid distributor 20 and may or may not release steam to the steam distributor 24. In some aspects, the vacuum motor remains actuated/on in each of the selectable cleaning modes, such that suction remains actuated both when the trigger 70 is depressed and also when it is not depressed. In yet another embodiment, a separate steam dispensing control (not shown) selectively operates the steam valve 60 to control steam dispensing, while the trigger 70 selectively operates the liquid valve 58 to control liquid dispensing. A user may operate both controls at the same time for simultaneous liquid and steam dispensing.

The cleaning modes can have associated operating parameters for the heater 26, vacuum motor 36, liquid pump 50, and/or steam pump 54 (FIG. 2). The power cord 48 provides power to the electrical components of the extraction cleaner 10 from a source of power, such as a home power supply, upon actuation of a power button (not shown) dependent on the selected cleaning mode. Alternatively, the extraction cleaner 10 can be cordless and powered by a portable power supply, such as a battery, upon actuation of the power button dependent on the selected cleaning mode. As noted above, in all cleaning modes, the release of cleaning fluid can be controlled by the trigger 70. Alternatively, release of cleaning liquid can be controlled by the trigger 70 and release of steam can be controlled by a separate steam control. In some aspects, the vacuum motor 36 is activated in each of the selectable cleaning modes and remains activated in each cleaning mode regardless of whether or not the trigger 70 is depressed by the user.

Figure 4:
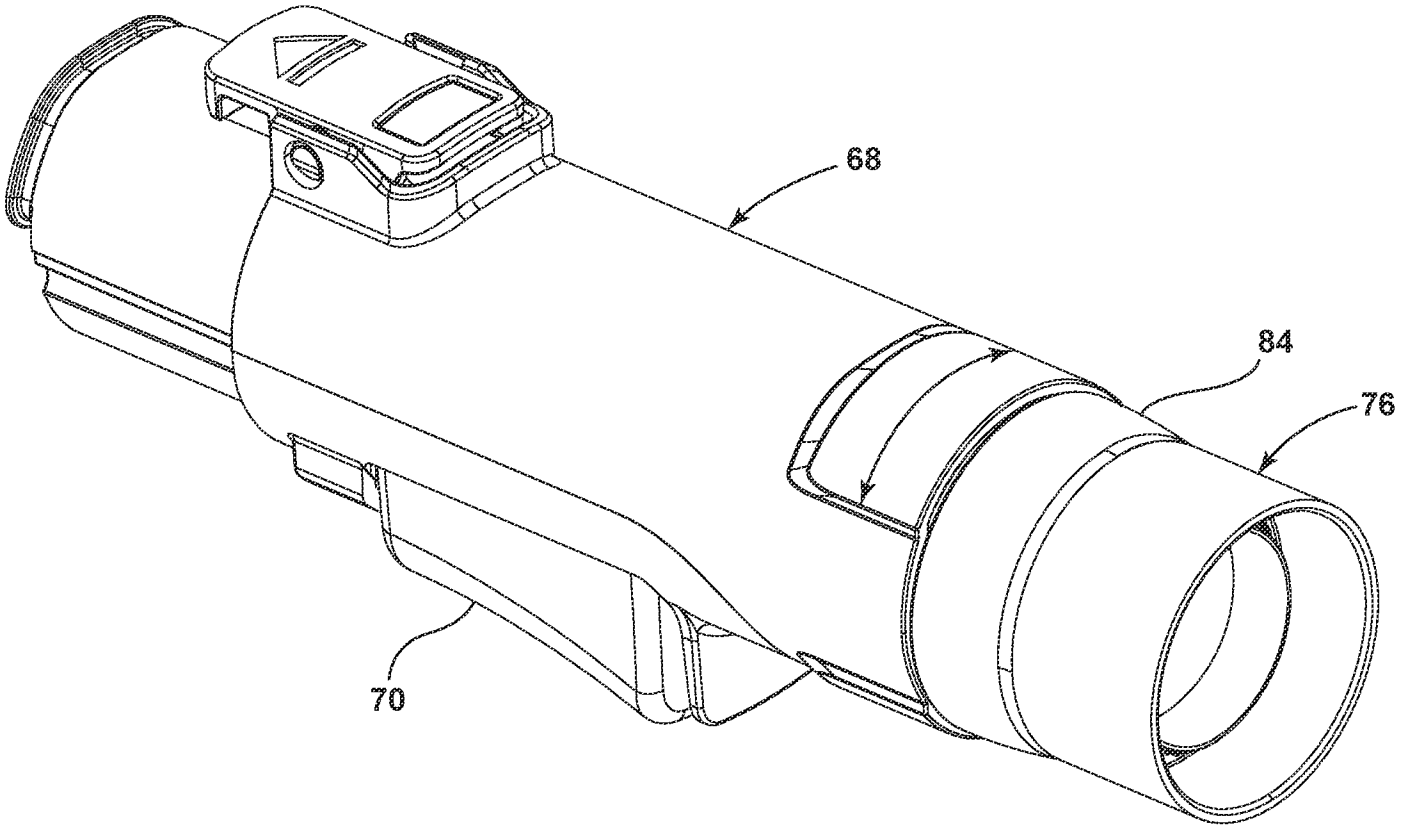
FIG. 4 is a perspective view of a wand of the cleaning tool and hose collar of the flexible hose.
Figure 5:
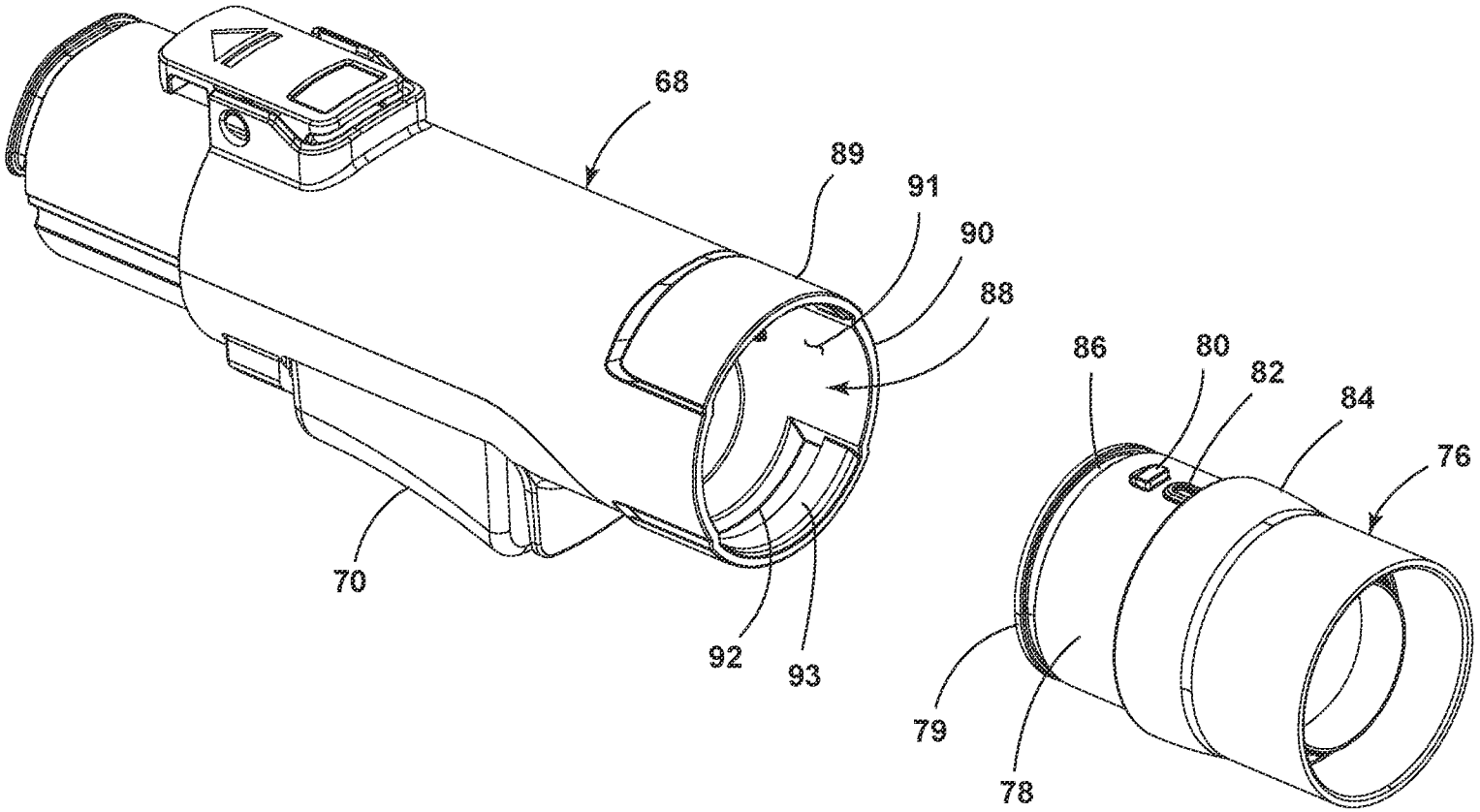
FIG. 5 is an exploded view of the wand and hose collar of FIG. 4.

Turning to FIGS. 3-7, the cleaning tool 22 is rotatably coupled with an end 72 of the flexible hose 32. In one aspect, the cleaning tool 22 swivels relative to the hose 32 in a limited angle of rotation. For example, the cleaning tool may swivel within a range of 60 to 180 degrees relative to the hose, such as approximately 180 degrees relative to the hose, approximately 175 degrees relative to the hose, approximately 170 degrees relative to the hose, approximately 165 degrees relative to the hose, approximately 160 degrees relative to the hose, approximately 155 degrees relative to the hose, approximately 150 degrees relative to the hose, approximately 145 degrees relative to the hose, approximately 140 degrees relative to the hose, approximately 135 degrees relative to the hose, approximately 130 degrees relative to the hose, approximately 125 degrees relative to the hose, approximately 115 degrees relative to the hose, approximately 110 degrees relative to the hose, approximately 105 degrees relative to the hose, approximately 100 degrees relative to the hose, approximately 95 degrees relative to the hose, approximately 90 degrees relative to the hose, approximately 85 degrees relative to the hose, approximately 80 degrees relative to the hose, approximately 75 degrees relative to the hose, approximately 70 degrees relative to the hose, approximately 65 degrees relative to the hose, or approximately 60 degrees relative to the hose. In certain aspects as shown in FIG. 4, the cleaning tool is swivelable approximately 85 to 95 degrees relative to the hose, preferably approximately 90 degrees.

In some aspects, the cleaning tool 22 includes the wand 68 and an accessory tool 74 that is removably connected to the wand and includes the tool components such as the fluid distributor 20, the steam distributor 24, the extraction nozzle 28, and the brush 44. The detachability of the accessory tool from the wand allows for the switching between various accessory tools that have different features, configurations, and uses. However, in other aspects the wand and accessory tool may be permanently connected as a single integral unit.

A hose collar 76 is disposed on the end 72 of the hose 32. The hose collar 76 is generally cylindrical in shape and has a cylindrical outer surface portion 78 at a tool coupling end 79 of the hose collar. At least one, preferably two, projections 80 project and extend outwardly in a radial direction from the outer surface 78. Each projection 80 may be a generally rectangular solid or rectangular pyramid with a sloped leading surface 81. However, the projection 80 is not limited to a particular polygonal shape and may conform to any of various geometries including cuboid, prismatic, diamond, triangular, or pyramidal. An anti-tilt projection in the form of a raised surface 82 is disposed behind (more inward relative to an end of the collar) and axially aligned with each projection. Each raised surface 82 may have a generally U-shape and has a smaller height than the projections 80 as discussed in more detail below, but the raised surfaces are not limited to a particular shape or cross-section and need only be disposed behind the projections 80. For example, the raised surfaces 82 may be in the form of a hemispherical protrusion. A raised annular ring 84 is located behind the raised surfaces 82 generally intermediate the two ends of the collar 76. A sealing ring such as an O-ring 85 or similar is disposed in an annular recess 86 at the end 72 of the hose collar 76 and abuts against a seat defined by the annular recess. The O-ring 85 seals the connection between the hose collar 76 and the wand 68 as described in more detail below.

The wand 68 includes a receiver 88 disposed at a rear end 89 of the wand opposite the accessory tool 74 connected to the wand. The receiver 88 includes a circular outer rim 90, a cylindrical inner surface 91 extending axially inward from the outer rim, and at least one arcuately extending guide groove 92 disposed in the cylindrical inner surface and extending along a portion of the circumference of the cylindrical inner surface. In some embodiments, the receiver 88 includes the same number of guide grooves 92 as the number of projections 80, preferably two guide grooves. In these embodiments, the two guide grooves 92 may be directly or nearly directly opposite each other on the cylindrical inner surface 91. Each guide groove 92 may extend less than 180 degrees around the circumference of the cylindrical inner surface 91, and in some embodiments, each guide groove extends approximately 90 degrees (e.g. 90 degrees±5 degrees) around the circumference of the cylindrical inner surface. Each one of the projections 80 is received in a unique one of the guide grooves 92 to thereby couple the tool 22 to the collar 76 of the hose 32. The arc length of the guide groove 92 in degrees defines the maximum swivel angle of the tool 22 relative to the hose 32.

Each guide groove 92 further includes a lip 93 adjacent the outer rim 90. The lip 93 is raised relative to the depth of the guide groove 92, but recessed relative to the inner surface 91 of the receiver 88. To insert the hose 32 onto the wand 68, the end 79 of the hose collar 76 is inserted into the receiver 88 of the wand. The sloped leading surface 81 of each projection 80 slides over a respective one of the lips 93 and snaps into the adjacent respective guide grooves 92. Once the projections 80 are received in the guide grooves 92, the inner edge 94 of the lips 93 generally prevent the projections from becoming freed from the guide grooves. Hence, a generally permanent coupling is formed between the hose collar 76 and the wand 68. In this disposition, the O-ring 85 provides a seal between the wand 68 and the hose 32 such that fluid is generally prevented from escaping from the inside of the wand and hose collar 76 to the outside.

Figure 6:
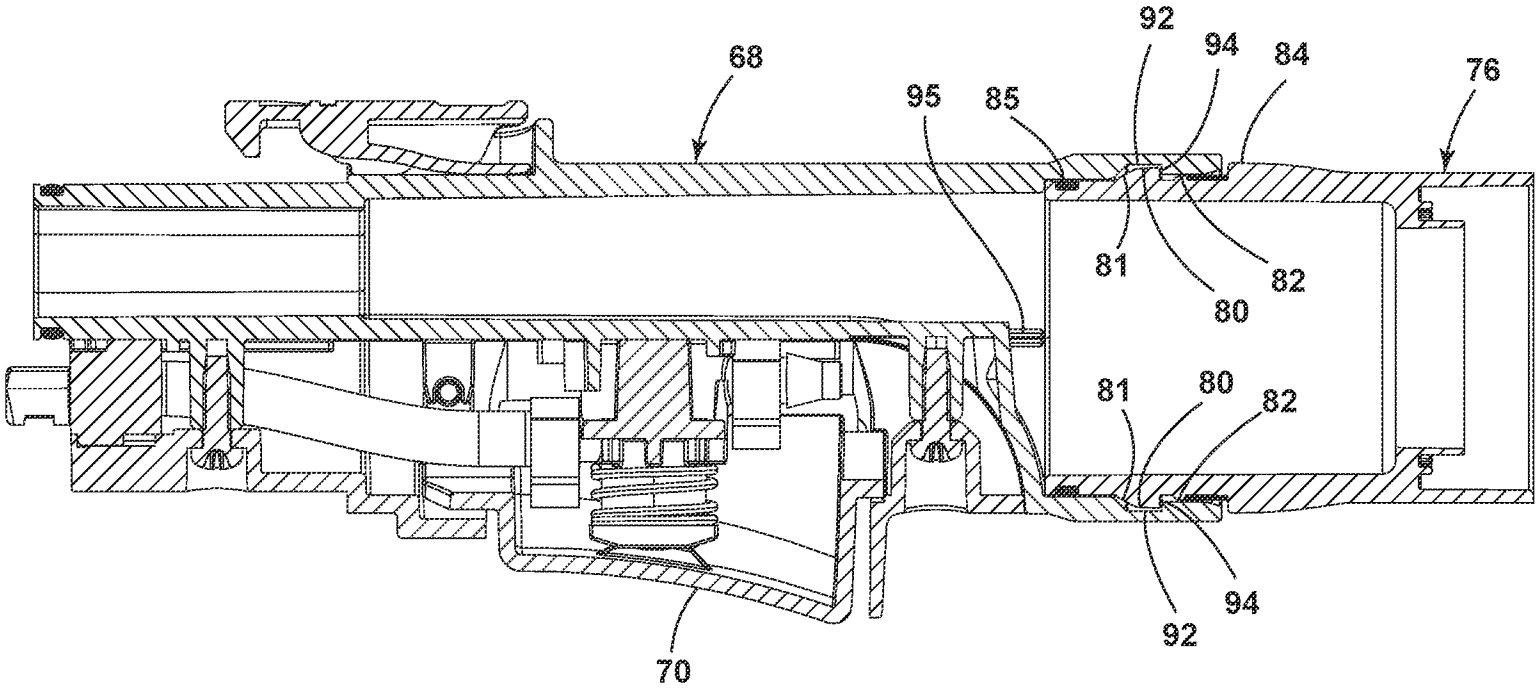
FIG. 6 is a cross-section view of the wand and hose collar of FIG. 4.
Figure 7:
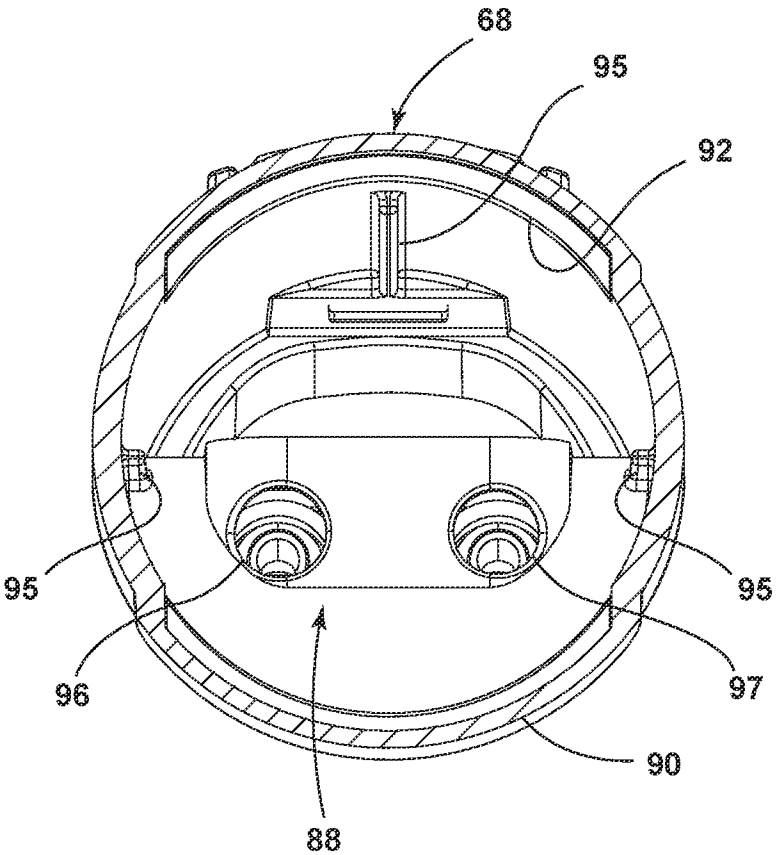
FIG. 7 is a perspective view of a receiver of the wand.

As shown best in FIG. 7, in some embodiments the receiver 88 further includes a plurality of anti-tilt ribs 95 extending axially along the cylindrical inner surface 91 of the receiver. In some embodiments, one or more of the anti-tilt ribs 95 may extend from the guide groove 92 inwardly into the wand 68. Other of the anti-tilt ribs 95 may extend inwardly from a point inward of the outer rim 90 of the receiver 88 and not aligned with the guide grooves 92. The receiver 88 also includes a connector/coupling 96 for the liquid dispensing path 52 conduit, and a connector/coupling 97 for the steam dispensing path 56 conduit. With reference to FIG. 6, the anti-tilt ribs 95 provide contact points between the end 72 of the hose collar 76 and the inside of the receiver 88 to limit the degree of tilting of the hose 32 relative to the wand 68. Similarly, the anti-tilt raised surfaces 82 on the hose collar 76 contact the lip 93 in the receiver 88 and further restrict tilting/play between the hose collar and wand. Additionally, in combination with the cooperation of the projections 80 and guide grooves 92, the anti-tilt ribs 95 limit inward travel of the hose collar 76 into the receiver 88. Also, the raised annular ring 84 on the collar 76 generally abuts against or is adjacent to the wand 68 at the interface between the wand and collar, and also may limit inward movement and/or tilt of the collar relative to the wand. The anti-tilt ribs 95, by minimizing the amount of play between the hose collar and wand, are particularly useful to minimize leakage of extracted liquid when the wand is rotated relative to the hose collar.

A user may grip the wand 68 to manipulate the accessory tool 74 for cleaning of surfaces. During this use, the wand 68 may rotate relative to the hose collar 76 due to the guide grooves 92 sliding along the projections 80 or vice versa, thereby allowing the tool to be more easily turned to reach and align with the surface to be cleaned despite the various possible relative positions of the extraction cleaner 10, the hose 32, and the user. The degree of rotation of the wand 68 is limited by the arc length of the guide grooves 92 and is necessary due to the liquid dispensing path 52 and/or steam dispensing path 56 (in the form of supply lines) that run through the hose 32 and wand 68. More particularly, contact of each projection 80 with the ends of the respective guide groove 92 prevents further rotation of the wand 68 relative to the hose 32 in the clockwise and counterclockwise directions. Therefore, by limiting the degree of rotation, the combination of the hose collar 76 and receiver 88 of the wand 68 minimize the likelihood of twisting of the fluid lines (either the liquid/solution path 52 and/or the steam path 56) that run through the hose 32 and wand 68 when the wand is rotated relative to the hose. Further, as discussed above, the anti-tilt ribs 95 limit the degree of tilting of the hose collar 76 relative to the wand 68, which minimizes the chance of fluid leakage at the connection between the hose collar and wand when a user manipulates the wand. Furthermore, the two-piece design (hose collar 76 and receiver 88) of the rotating connection between the hose 32 and wand 68 is simple to assemble (the projections 80 snap into the guide grooves 92) and cost-effective. Additionally, once the hose collar 76 is snapped into the receiver 88 in the wand 68, the hose collar is not easily removed from the receiver.

Figure 8:
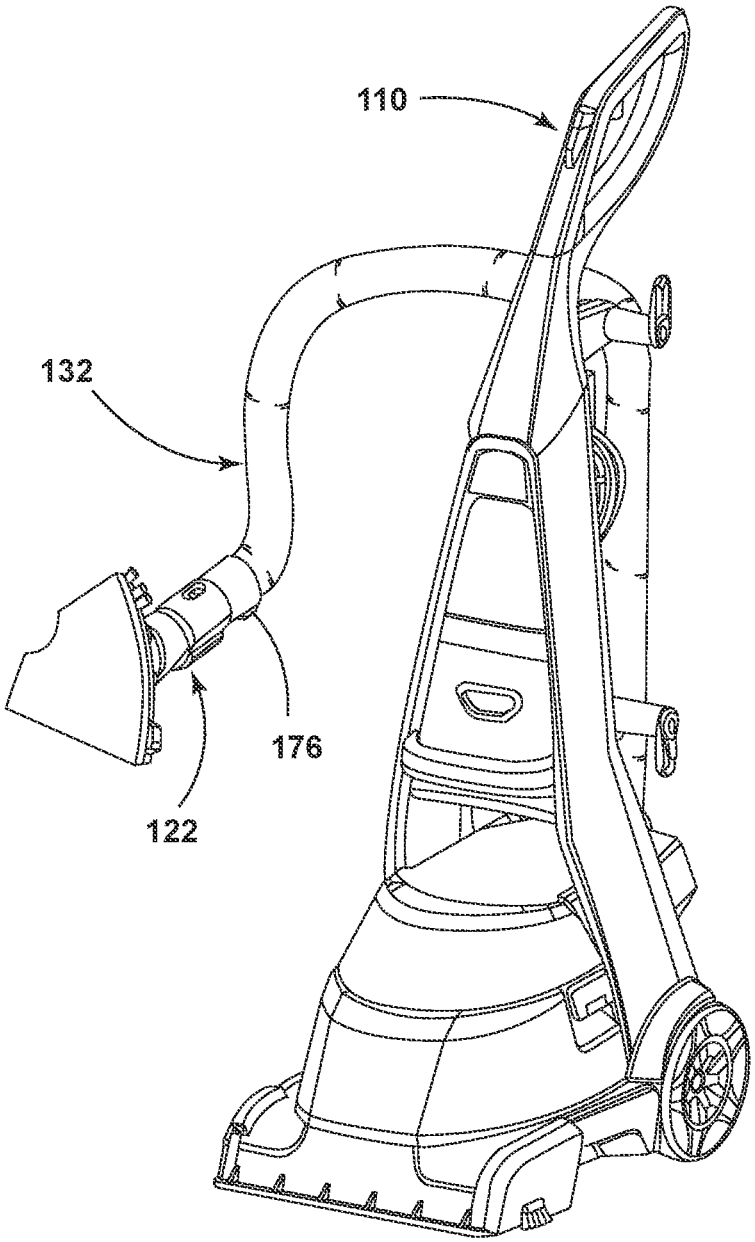
FIG. 8 is a perspective view of an upright extraction cleaner with a rotating tool grip according to other embodiments of the invention.

While shown on a portable device adapted to be hand carried by a user for cleaning relatively small areas, in other embodiments the functional systems of the surface cleaning apparatus with steam delivery can be arranged into other configurations, such as an upright device having a base and an upright body for directing the base across the surface to be cleaned, a canister device having a cleaning implement connected to a wheeled base by a vacuum hose, or a commercial device. Any of the aforementioned cleaners can be adapted to include a flexible vacuum hose, which can form a portion of the working air conduit between a nozzle and the suction source. As shown by example in FIG. 8, in some embodiments the cleaning tool 122 is rotatably coupled to the collar 176 flexible hose 132 of an upright extraction device (deep cleaner) 110.

While the device is illustrated as an extraction cleaner, in other embodiments the surface cleaning apparatus with steam delivery can be may be applicable surface cleaning apparatus which have steam delivery capability but not extraction capabilities.

To the extent not already described, the different features and structures of the various embodiments of the present disclosure may be used in combination with each other as desired. Thus, the various features of the different embodiments may be mixed and matched as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

The invention claimed is:

1. An extraction cleaner comprising:

a housing supporting a fluid delivery system configured to store cleaning fluid and to deliver the cleaning fluid to a surface to be cleaned, and a fluid recovery system configured to remove fluid and debris from the surface to be cleaned and to store the recovered fluid and debris;

a flexible hose comprising a first conduit in fluid communication with the fluid delivery system and a second conduit in fluid communication with the fluid recovery system;

a hand-held cleaning tool comprising a fluid distributor and a suction inlet, the cleaning tool including a wand and an accessory tool removably connected to the wand;

a receiver disposed at a rear end of the wand opposite the accessory tool, the receiver including a circular outer rim and a cylindrical inner surface extending inwardly from the outer rim; and a plurality of anti-tilt ribs extending axially along the cylindrical inner surface of the receiver, each anti-tilt rib projecting from the cylindrical inner surface of the receiver and including a raised surface that is raised from the cylindrical inner surface of the receiver, each anti-tilt rib providing a contact point between the end of the hose and the inside of the receiver to limit a degree of tilting of the hose relative to the wand;

the flexible hose including a first terminal end coupled to the housing and an opposite, second terminal end coupled to the cleaning tool;

the cleaning tool being directly rotatably coupled with the second terminal end of the hose distal from the housing;

wherein the cleaning tool swivels relative to the second terminal end of the flexible hose in a limited angle of rotation without becoming disconnected from the end of the hose, and the cleaning tool is rotatably coupled to the hose for rotation of the cleaning tool relative to the hose during use.

2. The extraction cleaner of claim 1, wherein a hose collar is disposed on the end of the flexible hose.

3. The extraction cleaner of claim 2, wherein the hose collar includes a cylindrical outer surface and at least one projection extending outwardly from the cylindrical outer surface; and the receiver includes at least one arcuately extending guide groove disposed in the cylindrical inner surface;

wherein each one of the at least one projection is received in a unique one of the at least one guide groove.

4. The extraction cleaner of claim 3, wherein each guide groove of the at least one guide groove extends less than 180 degrees around a circumference of the cylindrical inner surface.

5. The extraction cleaner of claim 1, wherein the fluid delivery system comprises a liquid and/or steam delivery system configured to deliver the cleaning fluid to the surface to be cleaned as liquid, steam, or both.

6. The extraction cleaner of claim 1, wherein the extraction cleaner is a portable deep cleaner and the housing comprises a hand-carried body adapted to be hand carried by a user.

7. The extraction cleaner of claim 1, wherein the extraction cleaner is an upright deep cleaner and the housing comprises a base adapted to move over the surface to be cleaned and an upright body coupled with the base.

8. The extraction cleaner of claim 1, wherein the limited angle of rotation is in a range of approximately 85 to 95 degrees.

9. A hose assembly for an extraction cleaner having a fluid delivery system and a fluid recovery system, the hose assembly comprising:

a flexible hose comprising at least a liquid delivery conduit and a working air conduit, the flexible hose including a first terminal end and an opposite second terminal end;

a hand-held cleaning tool directly rotatably coupled with the second terminal end of the hose, the cleaning tool comprising a fluid distributor and a suction inlet;

a hose collar disposed on the end of the hose;

a receiver disposed at a rear end of the cleaning tool;

the receiver including a circular outer rim, a cylindrical inner surface extending inwardly from the outer rim, and at least one arcuately extending guide groove disposed in the cylindrical inner surface, each of the at least one guide groove extending circumferentially along the inner surface and terminating at two opposite, closed ends inwardly disposed from the outer rim; and a plurality of anti-tilt ribs extending axially along the cylindrical inner surface of the receiver, each anti-tilt rib projecting from the cylindrical inner surface of the receiver and including a raised surface that is raised from the cylindrical inner surface of the receiver, each anti-tilt rib providing a contact point between the end of the hose collar and the inside of the receiver to limit a degree of tilting of the hose relative to the wand;

the hose collar including a cylindrical outer surface and at least one projection extending outwardly from the cylindrical outer surface;

wherein the at least one projection is cooperable with the at least one guide groove such that the cleaning tool swivels relative to the second terminal end of the flexible hose in a limited angle of rotation, wherein the at least one projection on the hose collar is retained in the at least one guide groove by the two opposite, closed ends, and the two opposite, closed ends are contactable by the at least one projection to limit a maximum degree of rotation of the cleaning tool relative to the hose collar.

10. The hose assembly of claim 9, including two of said guide grooves and a corresponding two of said projections.

11. The hose assembly of claim 9, wherein each of the at least one guide groove extends approximately 90 degrees around a circumference of the cylindrical inner surface.

12. The hose assembly of claim 9, wherein each of the at least one guide groove includes a lip adjacent the outer rim.

13. The hose assembly of claim 9, including a raised surface axially aligned with each of the projections.

14. The hose assembly of claim 9, wherein the flexible hose further comprises a steam delivery conduit.

15. An extraction cleaner comprising:

a housing supporting a fluid delivery system configured to store cleaning fluid and to deliver the cleaning fluid to a surface to be cleaned, a steam delivery system configured to deliver steam to the surface to be cleaned, and a fluid recovery system configured to remove fluid, condensed steam, and debris from the surface to be cleaned and to store the recovered fluid, condensed steam, and debris;

a flexible hose comprising a liquid delivery conduit in fluid communication with the fluid delivery system, a steam delivery conduit in fluid communication with the steam delivery system, and a working air conduit in fluid communication with the fluid recovery system;

a hand-held cleaning tool comprising a fluid distributor in fluid communication with the liquid delivery conduit and the steam delivery conduit, and a suction inlet in fluid communication with the working air conduit;

the flexible hose including a first terminal end coupled to the housing and an opposite, second terminal end coupled to the cleaning tool;

the cleaning tool further comprising a wand and an accessory tool removably connected to the wand;

a receiver disposed at a rear end of the wand opposite the accessory tool, the receiver including a circular outer rim and a cylindrical inner surface extending inwardly from the outer rim; and a plurality of anti-tilt ribs extending axially along the cylindrical inner surface of the receiver, each anti-tilt rib projecting from the cylindrical inner surface of the receiver and including a raised surface that is raised from the cylindrical inner surface of the receiver, each anti-tilt rib providing a contact point between the end of the hose and the inside of the receiver to limit a degree of tilting of the hose relative to the wand;

the wand being directly rotatably coupled with the second terminal end of the hose distal from the housing;

wherein the cleaning tool swivels relative to the second terminal end of the flexible hose in a limited angle of rotation without becoming disconnected from the end of the hose, and the cleaning tool is rotatably coupled to the hose for rotation of the cleaning tool relative to the hose during use.

16. The extraction cleaner of claim 15, further comprising a hose collar including a cylindrical outer surface and at least one projection extending outwardly from the cylindrical outer surface; and wherein the receiver includes at least one arcuately extending guide groove disposed in the cylindrical inner surface;

wherein each one of the at least one projection is received in a unique one of the at least one guide groove.

17. The extraction cleaner of claim 16, wherein each of the at least one guide groove extends approximately 90 degrees around a circumference of the cylindrical inner surface such that the wand is swivelable through an approximately 90-degree angle of rotation relative to the hose collar.

18. The extraction cleaner of claim 15, wherein the extraction cleaner is a portable deep cleaner and the housing comprises a hand-carried body adapted to be hand carried by a user.

19. The extraction cleaner of claim 15, wherein the extraction cleaner is an upright deep cleaner and the housing comprises a base adapted to move over the surface to be cleaned and an upright body coupled with the base.

* * * * *